United States Patent [19]

Takada

[11] Patent Number: 4,802,795

[45] Date of Patent: Feb. 7, 1989

[54] PLATEN FIXING APPARATUS

[75] Inventor: Masaaki Takada, Tokyo, Japan

[73] Assignee: Kabushiki Kaisha Toshiba, Kawasaki, Japan

[21] Appl. No.: 110,666

[22] Filed: Oct. 20, 1987

[30] Foreign Application Priority Data

Oct. 24, 1986 [JP] Japan ..... 61-163252

[51] Int. Cl.[4] ..... B41J 11/04

[52] U.S. Cl. ..... 400/660; 400/692

[58] Field of Search ..... 400/660, 660.1, 660.2, 400/637.1, 636.1, 692; 384/439, 443, 256

[56] References Cited

U.S. PATENT DOCUMENTS 1,177,031 3/1916 Gruner ..... 400/660.1
1,629,514 5/1927 Latta ..... 400/660.1

FOREIGN PATENT DOCUMENTS 61-47649 3/1986 Japan ..... 400/660.2
149381 7/1986 Japan ..... 400/660

*Primary Examiner*—Charles Pearson
*Attorney, Agent, or Firm*—Finnegan, Henderson, Farabow, Garrett & Dunner

[57] ABSTRACT

An apparatus for fixing a platen includes a pair of parallel supporting plates, and a pair of fixing members fitted to end portions of a platen shaft supporting the platen. Each supporting plate has a round supporting hole and a guide hole extending from the supporting hole up to an upper end edge of the supporting plate and having a width smaller than the diameter of the supporting hole. Each fixing member includes a cylindrical body into which the end portion of the platen shaft is rotatably inserted, and an intermediate portion formed on the body and fitted into the supporting hole. An operating arm extends from the body, for rotating the fixing member between a fixed position where the intermediate portion is stably fitted in the supporting hole and a mounting position where the fixing member can be pulled out from the supporting hole through the guide hole. The fixing member is prevented from moving in the axial direction of the platen shaft by a flange formed on the body and a stepped portion formed on the end portion of the platen shaft. When the fixing member is moved to the fixed position, its rotation about the platen shaft is prevented by a projection formed on the operating arm and engaging an engaging hole formed in the supporting plate and a grip portion provided at the operating arm and being contact with the upper end edge of the supporting plate.

6 Claims, 3 Drawing Sheets

PLATEN FIXING APPARATUS

BACKGROUND OF THE INVENTION

This invention relates to a platen fixing apparatus for fixing a platen to the frame of a printer.

Generally, a printer has a platen which is rotatably coupled to the frame of a printer. The platen comprises a cylindrical body made of elastic material such as rubber, and a platen shaft inserted in the cylindrical body, with its ends projecting from both ends of the cylindrical body. Each end of the platen shaft is inserted rotatably in a bushing. This bushing is held unrotatably in a supporting hole made in the frame. A snap ring mounted at each end of the platen shaft to restrain the bushing from moving in the axial direction of the platen shaft.

With the above construction, the snap rings need to be attached to the platen shaft in order to mount the platen to the frame, and also must be detached from the platen shaft in order to remove the platen from the frame. It is rather cumbersome to attach and detach the rings to and from the shaft. Further, either snap ring cannot prevent a radial play of the bushing in the supporting hole, and the platen can hardly be attached to the frame in a sufficient stability.

With other conventional platen fixing apparatuses, each end of the platen shaft is inserted rotatably into a bushing, which is mounted in a support recess formed in the frame. A retaining arm is mounted rotatably at one end on the frame and connected thereto by means of a screw. After the bushing is fitted in the supporting recess, the retaining arm is turned to a position where its other end is pressed on the circumferential surface of the bushing. Under this condition, the bushing is held fixedly by the retaining arm in the supporting recess, provided the retaining arm is firmly connected to the frame by means of the above-described screw.

With a platen fixing apparatus of the above construction, it would be troublesome to mount a platen on a frame or dismount it therefrom since the screw of the retaining arm must be tightened or loosened. In addition, the retaining arm is fixed to the frame by one-point support with a screw, and there is a possibility that the retaining arm may turn in the direction of separating from the bushing, making it difficult for the platen to be fixed stably.

SUMMARY OF THE INVENTION

The present invention has been made in consideration of the above problem, and has as its object to provide a platen fixing apparatus capable of easy mounting and dismounting of a platen to and from the frame of a printer and also capable of fixing a platen to the frame stably.

In order to achieve the above object, a platen fixing apparatus of this invention comprises:

a frame including a pair of supporting plates separated for a specified distance and located in parallel, each supporting plate having an upper end edge, a supporting section and an engaging hole formed near the supporting section, the supporting section having a round supporting hole and a guide hole extending from the supporting hole up to the upper end edge of the supporting plate and also having a width smaller than the diameter of the supporting hole;

a platen shaft extending coaxially with the platen and having a pair of ends projecting from both ends of the platen; and a pair of fixing members for holding both ends of the platen shaft in the supporting sections to support the platen between the supporting plates, each fixing member including:

a cylindrical body into which one end of the platen shaft is rotatably inserted;

an intermediate part formed at the body and fitted into the supporting hole, the intermediate part having a pair of arcuate supporting faces with substantially the same diameter as that of the supporting hole and a pair of guide faces opposedly located and separated for a smaller distance than the width of the guide hole;

a first stopper extending from the body and contracting that side of the supporting plate which faces the platen, for restraining the fixing member from moving toward the supporting plate;

an operating arm extending radially from the body, for turning the fixing member between a fixed position where the supporting faces of the intermediate part contact an inner surfaces of the supporting hole and a mounting position where the guide faces of the intermediate part are aligned with the guide hole so that the fixing member can be pulled out from the supporting hole through the guide hole; and a restraining projection for engaging the engaging hole to restrain the fixing member from rotating when the fixing member is located at the fixed position; each end of the platen shaft having a second stopper for preventing the fixing member from moving toward the platen.

BRIEF DESCRIPTION OF THE DRAWINGS

FIGS. 1 to 6 show a platen fixing apparatus according to an embodiment of the present invention; in which FIG. 1 is a perspective view of the apparatus;

FIG. 2 is a perspective view showing a fixing member and an end of a platen shaft;

FIGS. 3 and 4 are a front view and a side view, respectively, showing the fixing member and its vicinity under the condition that a platen is fixed to a frame; and FIGS. 5 and 6 are side views, corresponding to FIG. 4, each showing steps of fixing the platen to the frame.

DETAILED DESCRIPTION OF THE PREFERRED EMBODIMENTS

Embodiments of this invention will now be described in detail with reference to the accompanying drawings.

Figure 1:
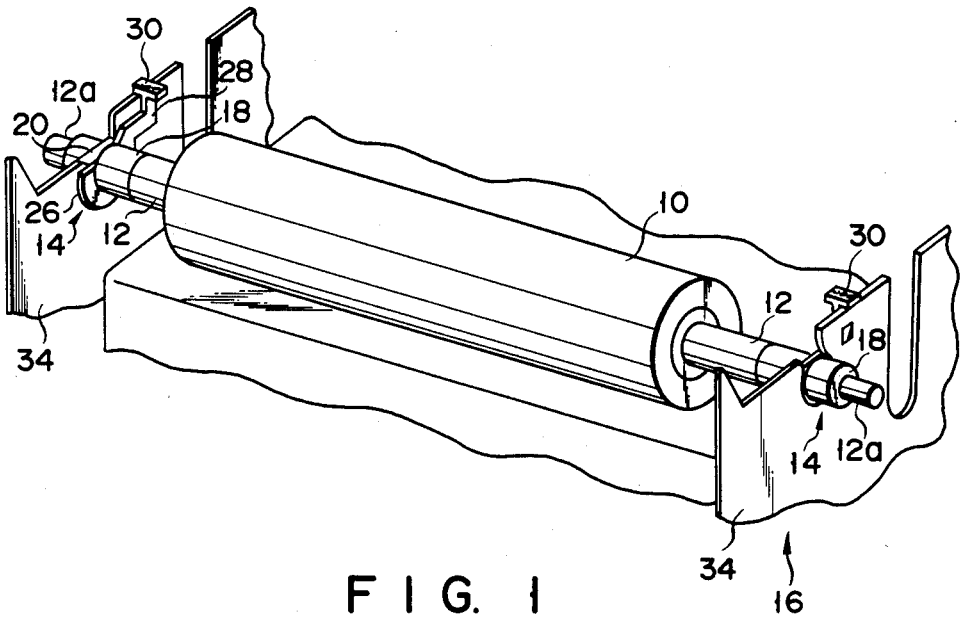
Figure 2:
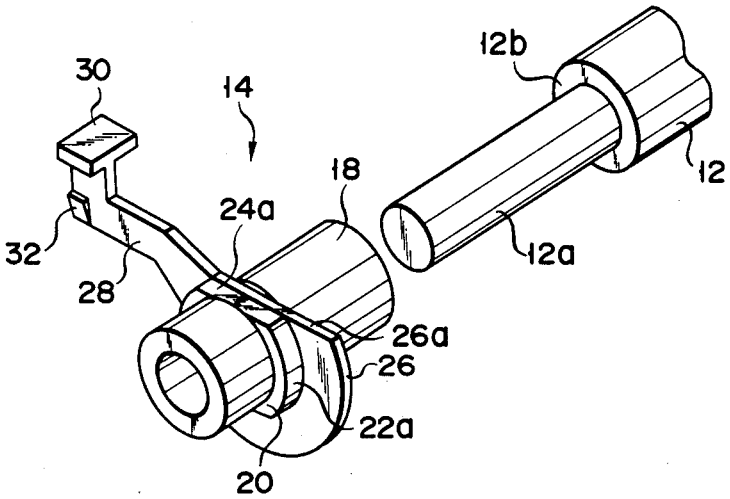

Referring to FIG. 1, a platen fixing apparatus comprises platen shaft 12, which is inserted in the inner hole of cylindrical platen 10, whose peripheral surface is covered with rubber, and supports platen 10. Both end portions of platen shaft 12 project from the ends of platen 10 and are each fixed to frame 16 by means of fixing member 14.

Put in greater detail, as is shown in FIGS. 1 to 5, each end portion of platen shaft 12 is stepped to have small-diameter portion **12*a* located at the free end and stepped portion 12*b* located at the proximal end of the small-diameter portion. Fixing members 14 are fitted to small-diameter portions 12***a*, respectively.

Each fixing member 14 has cylindrical body 18, into which small-diameter portion 12*a* of platen shaft 12 is rotatably inserted. The outer diameter of body 18 is substantially equal to the diameter of platen shaft 12. Body 18 abuts at one end against stepped part 12*b* of platen 12, thereby restricting the movement of body 18 toward platen 10. Body 18 has at its nearly mid-position ring-shaped intermediate portion 20, which is coaxial with body 18. Intermediate portion 20 is larger in diameter than body 18. Upper and lower parts of intermediate portion 20 are cut off and so that portion 20 has a pair of opposed arcuate supporting faces 22*a* and 22*b* and a pair of opposed and mutually parallel guide faces 24*a* and 24*b*. That is, the profile of the peripheral surface of intermediate portion 20 resembles a field track in shape. In addition, body 18 includes flange 26 located on that side of intermediate portion 20 which faces platen 10. Flange 26 is in a fan shape and extends radially from body 18 beyond intermediate portion 20. Flange 26 has end face 26*a* located in the same plane as guide face 24*a* of intermediate portion 20. Fixing member 14 has operating arm 28 which extends from flange 26 in a direction perpendicular to the axis of body 18 and substantially in parallel with end face 26*a* of flange 26. Operating arm 28 includes, at its extended end, grip portion 30, which has a flat plate extending in the axial direction of body 18. In addition, a wedge-shaped projection 32 is formed at the extended end of operating arm 28. Fixing members 14 provided in a pair of formed mutually symmetric.

Figure 3:
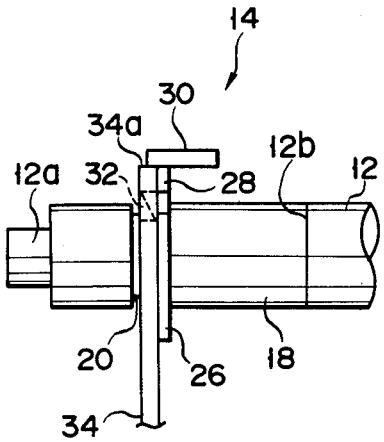
Figure 4:
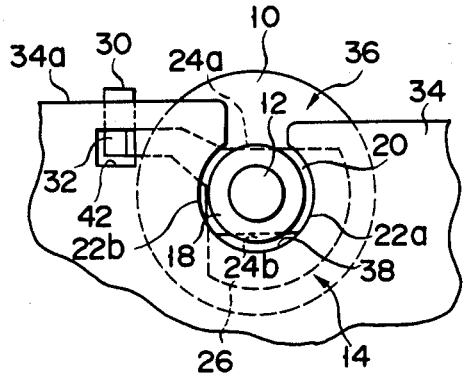
Figure 5:
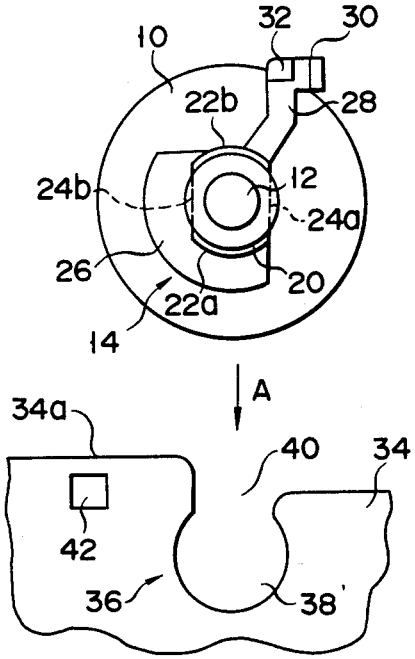

Frame 16 has a pair of mutually parallel supporting plates 34, which are installed a specified distance apart from each other. In other words, supporting plates 34 are separated substantially the same distance as the space between flanges 26 of the pair of fixing members 14 mounted at both ends of platen shaft 12. As is shown in FIGS. 3 to 5, each supporting plate 34 has supporting section 36 wherein fixing member 14 is secured. This supporting section 36 has round supporting hole 38 having substantially the same diameter as that of intermediate portion 20 of fixing member 14, and also has guide hole 40 extending nearly vertically from supporting hole 30 up to upper end edge 34*a* of supporting plate 34. The width of guide hole 40 is nearly equal to the distance between guide faces 24*a* and 24*b* of intermediate portion 20. Rectangular engaging hole 42 is formed in supporting plate 34 and located beside supporting section 36.

As may be clear from FIGS. 3 and 4, fixing member 14 is fixedly held by supporting plate 34 with intermediate portion 20 inserted in supporting hole 38. Both supporting faces 22*a* and 22*b* of intermediate portion 20 are in contact with the inner surface of supporting hole 38 and guide faces 24*a* and 24*b* are positioned horizontally. Therefore, intermediate portion 20 is prevented from moving in a direction perpendicular to platen shaft 12 and securely held in supporting hole 38. Projection 32 of operating arm 28 is fitted in engaging hole 42 of supporting plate 34 and the underside of grip portion 30 is in contact with upper end edge 34*a* of supporting plate 34. Hence, fixing member 14 is prevented from rotating about platen shaft 12. Flange 26 is in contact with that side of supporting plate 34 which faces platen 10. As has been mentioned earlier, one end of body 18 of fixing member 14 is in contact with stepped portion 12*b* of platen shaft 12. Therefore, fixing member 14 is prevented from moving in the axial direction of platen shaft 12. As described above, since fixing members having the ends of platen shaft 12 inserted thereinto are attached to supporting plates 34 of frame 16, platen 10 is rotatably held between supporting plates 34.

Now, how to fix platen 10 to frame 16 by use of the platen fixing apparatus constructed as described above will be described.

Fixing member 14 is mounted on each of small-diameter portions 12*a* of platen shaft 12. At this time, small-diameter portion 12*a* is inserted into body 18 of fixing member 14 until one end of body 18 contacts stepped portion 12*b*. Then, platen 10 is placed between supporting plates 34 such that intermediate portions 20 of fixing members 14 are located above corresponding supporting sections 36 of supporting plates, as is shown in FIG. 5. Each fixing member 14 is positioned such that operating arm 28 projects upward from platen shaft 12 and guide faces 24*a* and 24*b* of intermediate portion 20 are vertical, that is, aligned with guide hole 40 of supporting section 36. Thereafter, fixing members 14 are brought down together with platen 10 toward supporting plates 34 as indicated by arrow A of FIG. 4. Since the distance between guide faces 24*a* and 24*b* of intermediate portion 20 is set to be substantially equal to the width of guide hole 40 of supporting section 36, intermediate portion 20 can pass through guide hole 40 and enter supporting hole 38. Thus, as is shown in FIG. 6, supporting face 22*a* of intermediate portion 20 contacts the inner surface of supporting hole 38 and also flange 26 comes into contact with that side of supporting plate 34 which faces platen 10.

Figure 6:
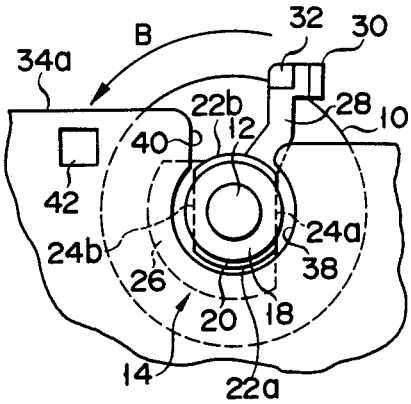

Then, fixing members 14 are turned about 90 degrees in the direction indicated by arrow B of FIG. 6 by pushing grip portion 30 of each operating arm 28. Consequently, as is shown in Fig, 4, guide faces 24*a* and 24*b* of intermediate portion 20 are positioned almost horizontally and supporting faces 22*a* and 22*b* are brought into contact with the inner surface of supporting hole 38. In this state, guide faces 24*a* and 24*b* are displaced 90 degrees from guide holes 40. Therefore, intermediate portions 20 cannot be pulled out of supporting holes 38 through guide holes 40 and held stably in supporting holes 38. At the same time, projection 32 formed in each operating arm 38 is fitted into engaging hole 42 of each supporting plate 34. The underside of grip portion 30 comes into contact with upper end edge 34a of each supporting plate 34. Hence, fixing members 14 are prevented from rotating about platen shaft 12.

By the above processes, each fixing member 14 is fixed stably to corresponding supporting plate 34. Therefore, platen shift 12 and platen 10 supported by fixing members 14 are stably fixed between supporting plates 34.

The mounting process indicated by FIGS. 5 and 6 can be performed by holding grip portion 30 of operating arm 28 of each fixing member 14 in each hand. Accordingly, the two fixing members can be simultaneously and easily attached to supporting plates 34. When dismounting platen 10 from frame 16, fixing members 14 can be removed by reversing the above-mentioned steps for mounting.

The platen fixing apparatus with the above construction has the following advantages. First, platen 10 can be fixed to frame 16 by a simple operation of inserting fixing members 14 into supporting section of supporting plates 34 and turning fixing members 14. Secondly, mounting snap rings and tightening screws, which used to be done conventionally, have been done away with, thereby improving the efficiency in assembling printers. Thirdly, each fixing member 14, fixed to frame 16, is restrained by stepped portion 12*b* of platen shaft 12 and flange 26 from moving in the axial direction of platen shaft 12. Further, each fixing member 14 is prevented by projection 32 and grip portion 30 from rotating about platen shaft 12. In addition, intermediate portion 20 of each fixing member 14, owing to the provision of supporting faces 22*a* and 22*b* and guide faces 24*a* and 24*b*, is prevented from moving in radial directions in supporting hole 38. Thus, intermediate portions 20 are stably held in supporting holes 38 without play. As a result, fixing members 14 and platen shaft 12 and platen 10 which are supported by fixing members 14 can be stably secured on frame 16. The result is that the displacement and vibration of the platen can be prevented and thereby the quality of printers is improved.

This invention is not limited to the foregoing embodiment thereof and various changes and modifications may be made within the scope of this invention.

Figure 7:
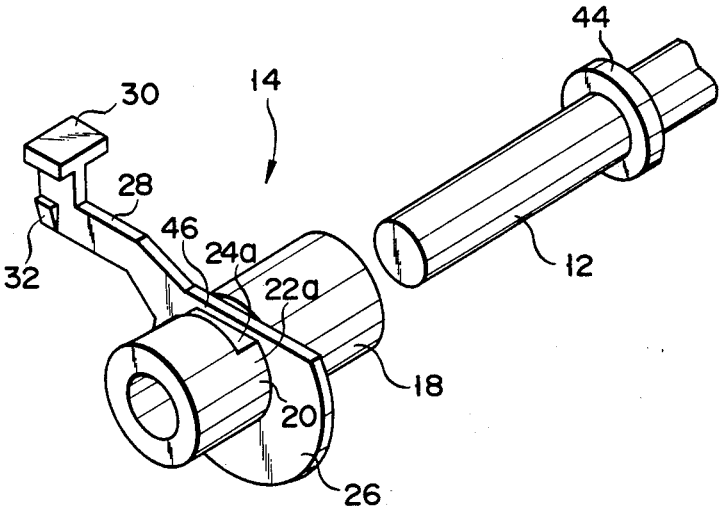
FIG. 7 is a perspective view showing a fixing member and a platen shaft in another embodiment of the present invention.

For example, as is shown in FIG. 7, annular projection 44 may be formed on each end portion of platen shaft 12 so as to constitute a stopper for preventing fixing member 14 from moving in the axial direction of platen shaft 12. The diameter of intermediate portion 20 may be the same as the diameter of body 18. In this case, grooves 46 are formed at the top and bottom of intermediate portion 20, and the bottom faces of the grooves constitute guide faces 24*a* and 24*b* (only guide face 24*a* is shown). Supporting faces 22*a* and 22*b* of intermediate portion 20 are defined by the circumferential surface of body 18. The diameter of supporting hole 38 of frame 16 is nearly identical to that of body 18.

With this embodiment, the same advantages as in the first embodiment of the present invention can be obtained.

What is claimed is:

1. An apparatus for fixing a platen, comprising:

a. a frame including a pair of parallel supporting plates separated by a specified distance, each of the supporting plates having an upper end edge, a supporting section, and an engaging hole formed near the supporting section, said supporting section having a round supporting hole and a guide hole extending from the supporting hole up to the upper end edge of the supporting plate, said guide hole having a width less than the diameter of the supporting hole;

b. a platen shaft extending coaxially with the platen and having a pair of ends projecting from both ends of the platen;

c. a pair of fixing members for holding both ends of the platen shaft in the supporting sections to support the platen between the supporting plates, each fixing member including:

a cylindrical body into which one end of the platen shaft is rotatably inserted;

an intermediate portion formed at said body and fitted into the supporting hole, the intermediate portion having a pair of arcuate supporting faces with substantially the same diameter as that of the supporting hole and a pair of guide faces positioned diametrically opposite each other and separated by a distance less than the width of said guide hole;

first stopper means, extending from the body and contacting that side of the supporting plate which faces the platen, for restraining the fixing member from moving toward the supporting plate;

operating means for turning the fixing member between a fixed position in which the supporting faces of the intermediate portion contact the inner surfaces of the supporting hole and a mounting position in which the guide faces of the intermediate portion are aligned with the guide hole so that the fixing member can be pulled out from the supporting hole through the guide hole, said operating means including an operating arm extending radially from the body and elastically deformable in the axial direction of the platen;

restraining means for holding said fixing member in the fixed position, said restraining means including (1) a grip portion formed at the extended end of the operating arm, said grip portion contacting the upper end edge of the supporting plate to restrain the fixing member from rotating in one direction when the fixing member is turned to the fixed position, and (2) a projection formed on the operating arm, said projection engaging the engaging hole of the respective supporting plate to restrain the fixing member from rotating in a direction opposite the one direction when the fixing member is located at the fixed position; and d. second stopper means at each end of the platen shaft for preventing the fixing member from moving toward the platen.

2. An apparatus according to claim 1, wherein said first stopper means includes a flange projecting radially from the cylindrical body of each of said fixing members.

3. An apparatus according to claim 1, wherein each end of said platen shaft has a small-diameter portion inserted into the body of one of said fixing members, and said second stopper means includes a stepped portion of said platen shaft abutting against said body of each of said fixing members.

4. An apparatus according to claim 1, wherein each of said operating arms extends substantially in parallel with one of the guide faces.

5. An apparatus according to claim 1, wherein said intermediate portion has an annular projection on the peripheral surface of the body, said supporting faces are formed by the peripheral surface of the annular projection, and said guide faces are formed by cutting off two mutually opposed parts of the annular projection.

6. An apparatus according to claim 1, wherein said body has a pair of grooves formed in the peripheral surface of the body, said supporting faces are formed by the peripheral surface of the body, and said guide faces are formed by the bottom faces of the grooves, respectively.

* * * * *